US010603693B2

(12) United States Patent
De Ghellinck D'Elseghem Vaernewijk et al.

(10) Patent No.: US 10,603,693 B2
(45) Date of Patent: Mar. 31, 2020

(54) WASTE SEPARATION APPLIANCE

(71) Applicant: Lange Christian SA, Andenne (BE)

(72) Inventors: Xavier De Ghellinck D'Elseghem Vaernewijk, Waterloo (BE); Christian Lange, Ohey (BE)

(73) Assignee: Lange Christian sa, Andenne (BE)

( * ) Notice: Subject to any disclaimer, the term of this patent is extended or adjusted under 35 U.S.C. 154(b) by 133 days.

(21) Appl. No.: 15/762,293

(22) PCT Filed: Sep. 29, 2016

(86) PCT No.: PCT/EP2016/073230
§ 371 (c)(1),
(2) Date: Mar. 22, 2018

(87) PCT Pub. No.: WO2017/055427
PCT Pub. Date: Apr. 6, 2017

(65) Prior Publication Data

US 2018/0297084 A1 Oct. 18, 2018

(30) Foreign Application Priority Data

Sep. 29, 2015 (BE) ..... 2015/5600

(51) Int. Cl.

| | |
|---|---|
| ***B07C 5/36*** | (2006.01) |
| ***E01H 1/08*** | (2006.01) |
| ***A47L 9/00*** | (2006.01) |

(52) U.S. Cl.
CPC ..... *B07C 5/36* (2013.01); *A47L 9/009* (2013.01); *E01H 1/0827* (2013.01); *E01H 1/0836* (2013.01); *B07C 2501/0054* (2013.01)

(58) Field of Classification Search
CPC . B07C 5/36; B07C 2501/0054; E01H 1/0836; E01H 1/0827; A47L 9/009
See application file for complete search history.

(56) References Cited

FOREIGN PATENT DOCUMENTS

| | | |
|---|---|---|
| EP | 0 640 720 A1 | 3/1995 |
| FR | 2 713 077 A1 | 6/1995 |
| FR | 2 777 922 A1 | 10/1999 |

*Primary Examiner* — David Redding
(74) *Attorney, Agent, or Firm* — Reinhart Boerner Van Deuren P.C.

(57) ABSTRACT

The invention relates to an appliance which is more particularly applicable in an urban or industrial vacuum cleaner into which the waste is sucked up and then collected in a container. The appliance comprises a flexible tube, the proximal end of which receives the waste and the distal end of which is held by a ring which is pivotable such that the ring can be positioned in one of several pre-defined positions. This variable positioning allows the waste to be deposited in different containers or compartments, according to the characteristics thereof. The appliance can be controlled manually or automatically on the basis of electronic or optical sensors.

14 Claims, 3 Drawing Sheets

WASTE SEPARATION APPLIANCE

OBJECT OF THE INVENTION

Although various fields of use can be envisaged, the present invention relates more particularly to appliances (preferably self-propelled) with a heat engine or electric motor which allow the vacuuming of any type of urban or industrial waste and normally called urban or industrial vacuum cleaners.

The present invention relates more particularly to a waste separation appliance, installed in or on the vacuum cleaner, which allows sorting of the waste on the basis of a number of characteristics.

TECHNOLOGICAL BACKGROUND

Self-propelled appliances that are used as urban or industrial vacuum cleaners are mainly used by cleaning agents for cleaning urban, industrial and/or recreational sites. This type of appliance is usually equipped with a suction pipe which is handled by the cleaning agent and wherein the end of the pipe comes into contact with the areas to be cleaned, allowing direct vacuuming of the waste so as to lead it toward a suitable container placed on the appliance. In the devices that are known today, the waste is not separated, in particular according to the nature thereof or the composition thereof. Indeed, sorting objects according to their internal properties as soon as the waste is collected would be desirable. Providing a sorting appliance in or on the vacuum cleaner represents a considerable challenge, since it is necessary to take into account the specific constraints of the appliance, for example the often-standardized dimensions of the containers, as well as diameters of the pipes and flexible tubes used to lead the waste toward the container. These diameters can be approximately 10 cm or more, to make the machine capable of vacuuming objects of variable size. The aim of the present invention is to provide an appliance that meets these requirements.

SUMMARY OF THE INVENTION

The present invention relates to a waste separation appliance as described in the claims. It is an appliance that can be used more particularly but not exclusively for an urban or industrial vacuum cleaner in which the waste is vacuumed and then collected in a container.

Throughout this description, the terms "proximal end" and "distal end" are defined with respect to the direction of transfer of the waste or objects in the sorting appliance, therefore the objects first pass through the proximal end, and then through the distal end. The appliance according to the invention comprises a flexible tube, the proximal end of which receives the waste and the distal end of which is held by a ring which is pivotable so that the ring can be positioned in one of several predefined positions. This variable positioning makes it possible to deposit the waste in various containers or compartments, depending on the characteristics thereof, for example the nature thereof or the composition thereof. The appliance can be commanded manually or automatically based on the information given by electronic or optical detectors.

The invention therefore relates, in particular, to an appliance for separating and sorting waste comprising:

a frame, a ring having an opening, said ring being pivotable relative to the frame about an axis which is located outside the opening, a flexible tube having a proximal end and a distal end, the proximal end being suitable for receiving the waste, the distal end being connected to the ring, so that the waste passes through the opening of the ring, an actuator suitable for actuating the pivoting of the ring about said axis, so as to position the ring in a position, said position being one of several predefined positions, such that each position allows waste to be deposited and collected in a different container or compartment.

The appliance according to the invention preferably can be used for an urban or industrial vacuum cleaner. An urban or industrial vacuum cleaner is a mobile, preferably self-propelled, apparatus for cleaning urban, industrial and/or recreational sites. The urban or industrial vacuum cleaner is provided with a pipe configured to be handled by an operator so that the waste vacuumed by the pipe is led toward the flexible tube which is part of the appliance according to the invention.

According to a specific embodiment, the distal end of the flexible tube can freely move about its axis with respect to the ring during the pivoting of the ring.

In the latter case, one embodiment is presented as an appliance wherein the flexible tube is fixed at the distal end thereof to a pipe fixed in turn inside a hoop, said hoop being held by the ring in the plane of the hoop and in the direction perpendicular to this plane, while allowing the free rotation of the hoop about its central axis.

According to a specific embodiment, the hoop is held in the plane thereof by one or more plates having a first opening with a diameter greater than the outer diameter of the hoop, and in the direction perpendicular to said plane, by two plates having a second opening with a diameter smaller than the outer diameter of the hoop and greater than the outer diameter of the pipe, the ring being formed by the assembly of said plates having the first opening with the plates having the second opening.

Furthermore, the appliance according to the last embodiment can comprise two anti-friction plates installed on both sides of the hoop, respectively between the hoop and each of the plates having the second opening.

The appliance according to the invention can further comprise means for detecting the position of the ring, which are configured to detect whether or not the ring is in one of the predefined positions.

Said detection means can comprise electronic sensors mounted on the frame, these sensors being contactless position sensors, and wherein the ring comprises flat extensions which are positioned to face the sensors when the ring is in one of the predefined positions.

According to an embodiment of the appliance of the invention, the actuator comprises an electric motor configured to block the pivoting at the moment when the power supply of the motor is cut off.

The appliance according to the invention can comprise manual command means that allow an operator to position the ring in one of the predefined positions.

Upstream of the flexible tube, the appliance can comprise one or more detectors forming means for selecting the type of waste, which are suitable for detecting one or more characteristics, such as physical, geometric and/or chemical characteristics, of the waste. In this case, the positioning of the ring in one of the predefined positions will be advantageously commanded automatically based on signals generated by the detector or detectors.

The appliance according to this last embodiment can comprise anti-vibration means suitable for limiting the vibration forces acting on the detector or detectors.

In a specific embodiment of the appliance according to the invention, the proximal end of the flexible tube is fixed with respect to the frame.

The invention also relates to a waste vacuum cleaner provided with an appliance according to any one of the preceding claims. It can particularly be an urban or industrial vacuum cleaner.

DETAILED DESCRIPTION OF THE INVENTION

The present invention will be described in greater detail in one or more preferred embodiments of the invention with reference to the appended figures and for which elements or details can be combined. The same applies with regard to a combination of details taken up in the figures which represent the prior art with the main elements of the present invention.

Figure 1:
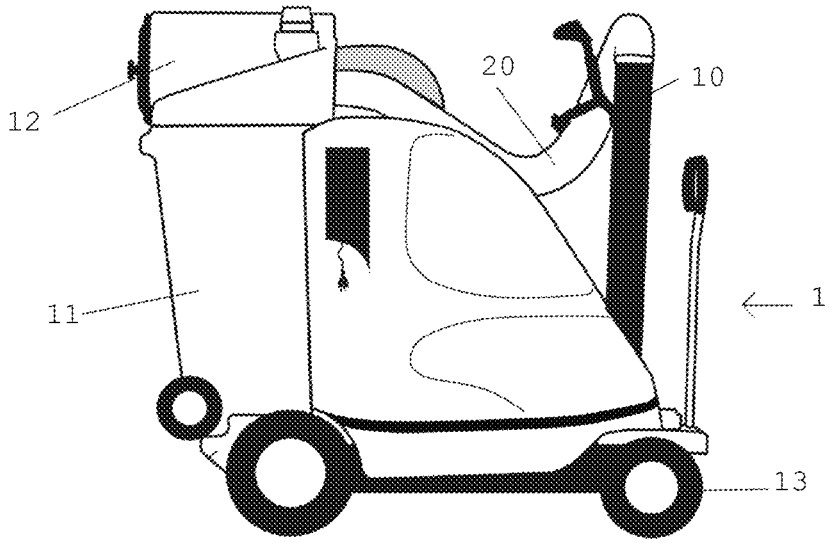
FIG. 1 is an overview of an urban or industrial vacuum cleaner, so as to illustrate the main field of use of the invention.

FIG. 1 is a general view of an urban or industrial vacuum cleaner as known today. The vacuum cleaner is illustrated by the reference 1. It is supplied with a suction pipe 10 which will be handled by the operator or cleaning agent so as to be in contact at a first end with the ground or the walls to be vacuumed, the second end being connected to a resilient pipe 20, essentially of the same diameter as that of the suction pipe 10. The second end of said preferably resilient pipe 20 will be connected directly to the vacuum cleaner 1. A container 11 collecting the waste, a filter 12, and the drive means 13 are also seen in FIG. 1.

Figure 2:
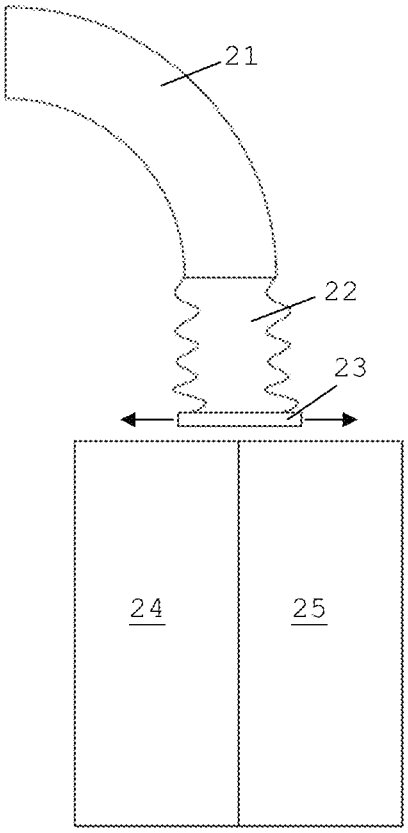
FIG. 2 shows the principle of separation of the appliance of the invention.

The separation principle on which the invention is based is then illustrated in FIG. 2 without, however, showing all the features of the invention. Inside the vacuum cleaner, the preferably resilient pipe 20 is connected to a preferably rigid pipe 21 that directs the incoming waste in a mainly vertical direction. A flexible tube 22 is located at the end of the rigid pipe 21, the proximal end of said flexible tube 22 being fixed on the pipe 21, and thus configured to receive the incoming waste, the distal end of the flexible tube 22 being connected to a ring 23 having a horizontal opening through which the waste will pass. The flexible tube 22 is therefore a flexible pipe that allows waste to pass through the pipe. The ring is movable between at least two positions so as to deposit the waste in either of the containers 24 and 25.

Figure 3:
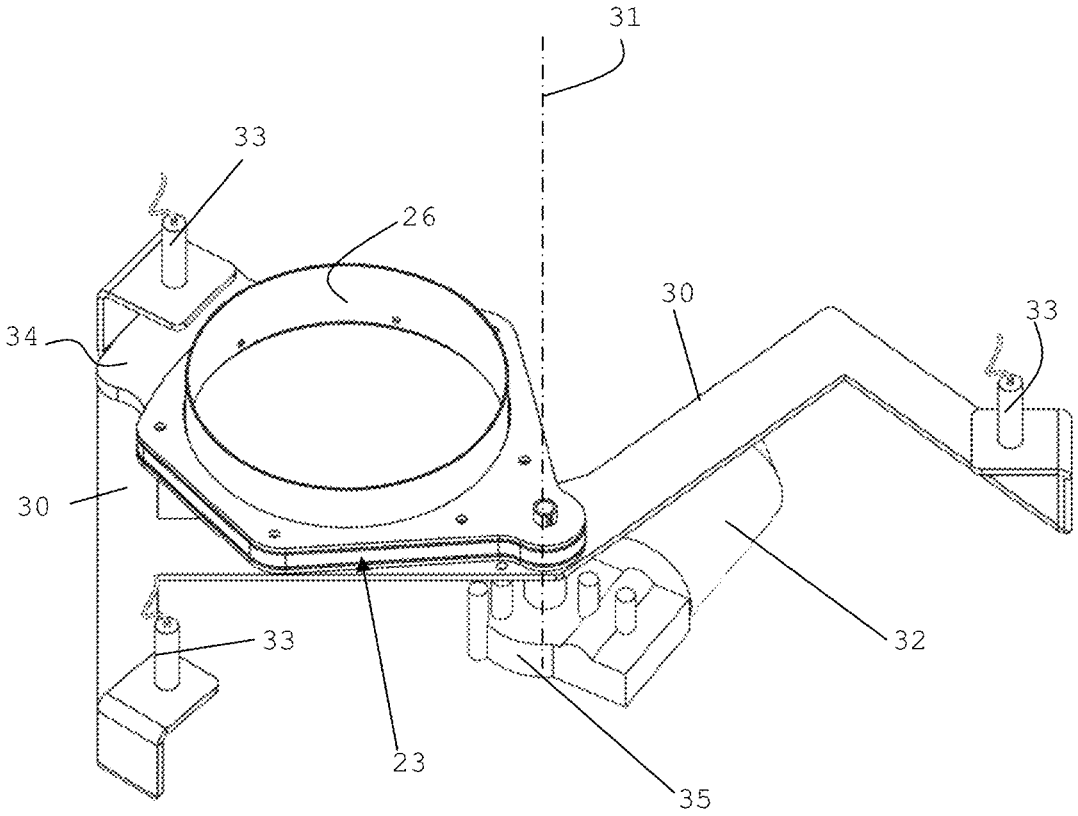
FIG. 3 shows the appliance of the invention according to a preferred embodiment.

The specific means for implementing this general principle are described below. FIG. 3 shows the appliance according to a preferred embodiment of the invention. The flexible tube 22 is not shown in this figure in order not to obstruct the complete view of the other elements. This flexible tube 22 will be fixed on a pipe 26, for example a PVC pipe of a few centimeters in height, which itself is connected to the ring 23. The pipe 26 and the opening of the ring 23 represent a diameter that allows the passage of waste of variable size, for example a diameter between 10 cm and 20 cm. According to this embodiment, the ring 23 forms an assembly of elements which allows the free rotation of the pipe 26 inside the ring 23, and which will be described in detail later.

The main feature of the invention is the manner in which the ring 23 together with the distal end of the flexible tube 22 (via the pipe 26), is moved into a plurality of predefined positions to allow the sorting of waste. In the embodiment shown in FIG. 3, three positions are provided for sorting the waste into three containers (not shown), in order to separate the objects according to the internal properties thereof. The ring 23 is suitable for being able to pivot about a vertical axis 31 located outside (of the opening) of the ring. This pivoting is actuated by an actuator which, in the embodiment shown in FIG. 3, comprises an electric motor 32 and a 90° gear transmission (35). Through this pivoting, the ring 23 will be positioned in one of the three predefined sorting positions. The actuator represented by the references 32 and 35 is mounted on a frame 30, itself fixedly mounted on the vacuum cleaner.

The position of the ring 23 is preferably controlled by means of three electronic sensors 33 mounted on the frame 30. The ring 23 is provided with a metal flat extension 34 which extends outward from the mean perimeter of the ring 23 while remaining parallel to the plane of the ring 26, and which will be positioned to face the sensors 33 at the moment when the ring 23 reaches one of the three sorting positions. The sensors 33 preferably operate according to the contactless detection principle, known per se by a person skilled in the art (inductive proximity switches). Signal processing means, known per se, are provided for detecting the signals generated by the sensors and deducing therefrom the position of the ring 23. Control means, also known per se, are provided for adjusting the positioning of the ring 23 by the actuator 32/35.

The actuator 32/35 preferably operates so that the movement is blocked when the power supply of the motor is interrupted. This makes it possible to easily maintain the position of the ring 26 when one of the predefined positions is reached. The motor must be restarted quickly, so as to be able to correct an undesired movement of the ring, by actuating, for example, the movement of the ring toward the correct sorting position. A type of motor+transmission combination appropriate for this purpose is a worm direct current gear motor.

Figure 4:
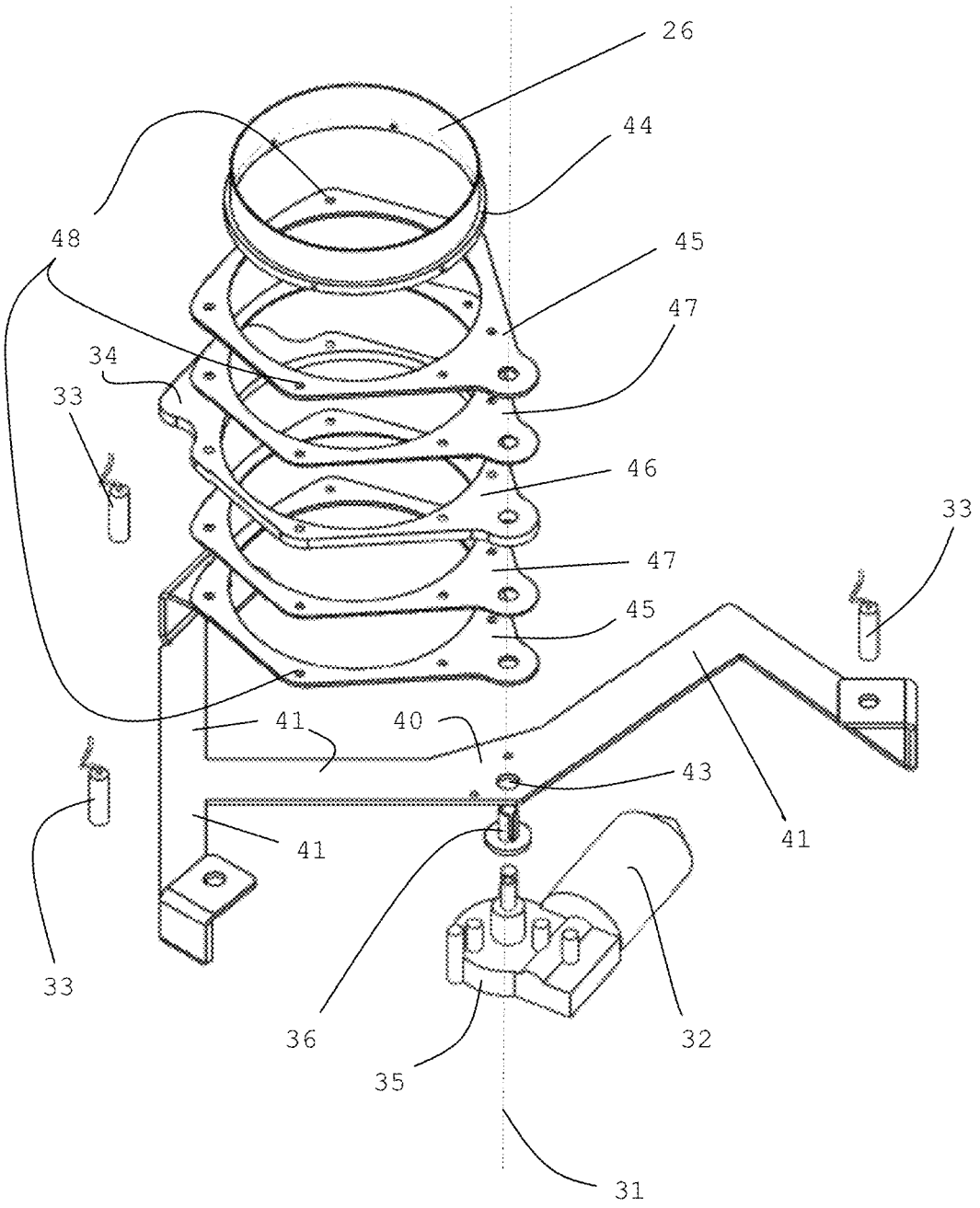
FIG. 4 shows the constituent elements of the appliance that is shown in FIG. 3.

FIG. 4 shows an exploded view of the constituent elements of the appliance. It is seen that the frame 30 comprises a central part 40 provided with a hole or orifice 43 which allows the passage of a rod 36 on which the various elements of the ring will be mounted so as to be able to pivot about the axis 31. The frame also comprises arms 41 extending outward from the central part 40 which carry, at the ends thereof, the sensors 33, so as to keep the sensors at positions that are distributed about the axis 31. The ring 23 comprises several elements. The pipe 26 is fixed at the distal end thereof inside a hoop 44 which is held in a vertical position by the two plates 45 which have an opening with a diameter smaller than the outer diameter of the hoop 44 and greater than the outer diameter of the pipe 26, respectively, allowing the ring 44 and the pipe 26 to rotate about their vertical axis. In the plane of the hoop 44, the latter is held by a plate 46 having an opening with a diameter greater than the outer diameter of the hoop 44 so as to keep the hoop 44 inside the set of the plates 45 and 46, while allowing the free rotation of the hoop 44 about its own central axis. The already-described flat extension 34, which will be positioned to face the sensors 33, is part of the plate 46. The plate 46 could be replaced by two plates of appropriate thickness. Plates 47 made of antifriction material are preferably provided on the two faces of the hoop 44, these plates 47 having the same shape as the plates 45. The assembly is secured by screwing via the holes or orifices 48 provided in the various elements. The material of the anti-friction plates 47 will facilitate the movement of the hoop 44 inside the assembled structure. This structure therefore allows the free rotation of the hoop 44 and therefore of the pipe 26 about the central axis thereof during the pivoting of the assembly about the axis 31. This configuration prevents excessive twisting of the flexible tube 22.

Sorting will be managed on the basis of certain characteristics of the collected waste.

According to one embodiment, the actuation of the separation appliance is triggered manually by the operator or cleaning agent who will have access to command means such as one or more buttons or a screen, through which the latter will be able change the position of the flexible tube 22 depending on the type of waste that the latter collects.

According to another embodiment, the selection is automatic based on a detection of certain characteristics related, for example, to the nature of the waste by electronic or optical detectors. Preferably, the detectors are positioned at the pipe 21 that is, in this case, supplied with openings suitable for receiving the detectors. The types of detectors that can be used are, for example, the detectors known in the prior art, capable of detecting the presence of metal components, or the detectors of non-metal components such as NIR (Near Infrared) detectors. The signals generated by these detectors will be transferred toward a command module which will command the actuation of the appliance of the invention depending on the detected components. In general, the NIR or equivalent detectors have a higher reaction time than the metal component detectors. For this reason, the NIR or equivalent detectors are preferably installed further away from the proximal end of the flexible tube 22 than the metal component detectors.

Preferably, anti-vibration means, such as supports made of a damping material, are provided to limit the vibration forces acting on the detectors during the operation of the vacuum cleaner.

The pivoting movement of the ring 26 makes it possible to have a compact structure, with an axis of rotation 31 in a central position, thereby making it possible to position the distal end of the flexible tube 22 at a plurality of positions located about the axis 31. This appliance can therefore be used with the same constraints to which a waste vacuuming apparatus as shown in FIG. 1 is subjected. The appliance can, of course, be used in an apparatus of different type and size, while keeping the above-mentioned advantages. For example, an appliance can be envisaged in which two, three or even more positions are provided about the axis 31 for sorting into a corresponding number of containers. Variants can also be envisaged for other features of the invention. For example, an electric motor could be used to be directly connected at the pivot axis 31 instead of a motor which acts via a 90° transmission. The pivot axis is preferably oriented perpendicularly to the opening of the ring 23, as is the case in the embodiments shown in the figures. This does not exclude the implementation of embodiments according to the invention in which an angle other than 90° is applied between the axis 31 and the opening of the ring 23. The proximal end of the flexible tube 22 is preferably held in a fixed position relative to the frame 30, although a free position of this end, preferably limited by constraints, is not excluded.

The invention claimed is:

1. An appliance for separating and sorting waste comprising:

a frame (30), a ring (23) having an opening, said ring being pivotable relative to the frame (30) about an axis (31) which is located outside the opening, a flexible tube (22) having a proximal end and a distal end, the proximal end being suitable for receiving the waste, the distal end being connected to the ring (23), so that the waste passes through the opening of the ring, an actuator (32/35) suitable for actuating the pivoting of the ring (23) about said axis (31), so as to position the ring in a position, said position being one of several predefined positions, such that each position allows waste to be deposited and collected in a different container or compartment.

2. The appliance according to claim 1, wherein the distal end of the flexible tube (22) can freely move about its axis with respect to the ring (23) during the pivoting of the ring.

3. The appliance according to claim 2, wherein the flexible tube (22) is fixed at the distal end thereof to a pipe (26) fixed in turn inside a hoop (44), said hoop being held by the ring (23) in the plane of the hoop and in the direction perpendicular to this plane, while allowing the free rotation of the hoop (44) about its central axis.

4. The appliance according to claim 3, wherein the hoop (44) is held in the plane thereof by one or more plates (46) having a first opening with a diameter greater than the outer diameter of the hoop (44), and in the direction perpendicular to said plane, by two plates (45) having a second opening with a diameter smaller than the outer diameter of the hoop (44) and greater than the outer diameter of the pipe (26), the ring (23) being formed by the assembly of said plates (46) having the first opening with the plates having the second opening (45).

5. The appliance according to claim 4, further comprising two anti-friction plates (47) installed on both sides of the hoop, respectively between the hoop (44) and each of the plates (45) having the second opening.

6. The appliance according to claim 1, comprising means (33) for detecting the position of the ring (23), which are configured to detect whether or not the ring is in one of the predefined positions.

7. The appliance according to claim 6, wherein the detection means comprise electronic sensors (33) mounted on the frame (30), these sensors being contactless position sensors, and wherein the ring comprises flat extensions (34) which are positioned to face the sensors (33) when the ring (23) is in one of the predefined positions.

8. The appliance according to claim 1, wherein the actuator comprises an electric motor (32) configured to block the pivoting at the moment when the power supply of the motor is cut off.

9. The appliance according to claim 1, comprising manual command means that allow an operator to position the ring (23) in one of the predefined positions.

10. The appliance according to claim 1, comprising, upstream of the flexible tube (22), one or more detectors suitable for detecting one or more characteristics of the waste, and wherein the positioning of the ring (23) in one of the predefined positions is commanded automatically based on signals generated by the detector or detectors.

11. The appliance according to claim 10, comprising anti-vibration means suitable for limiting the vibration forces acting on the detector or detectors.

12. The appliance according to claim 1, wherein the proximal end of the flexible tube (22) is fixed with respect to the frame (30).

13. A waste vacuum cleaner provided with an appliance as claimed in claim 1.

14. The vacuum cleaner according to claim 13, wherein the vacuum cleaner is an urban or industrial vacuum cleaner.

* * * * *